US007074046B2

(12) United States Patent
Kernan

(10) Patent No.: US 7,074,046 B2
(45) Date of Patent: Jul. 11, 2006

(54) DETACHABLE POWER SUPPLY APPARATUS

(75) Inventor: Colin Michael Kernan, Hingham, MA (US)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 10/686,498

(22) Filed: Oct. 15, 2003

(65) Prior Publication Data

US 2005/0085115 A1 Apr. 21, 2005

(51) Int. Cl.
*H01R 11/30* (2006.01)

(52) U.S. Cl. ..... 439/39

(58) Field of Classification Search ..... 439/39, 439/38, 369, 370, 371, 373, 343, 952, 575, 439/180, 271, 519; 219/494, 435
See application file for complete search history.

(56) References Cited

U.S. PATENT DOCUMENTS

| | | | | |
|---|---|---|---|---|
| 3,159,725 | A * | 12/1964 | Dennis | 200/51.09 |
| 3,363,214 | A | 1/1968 | Wright | 339/12 |
| 3,926,493 | A | 12/1975 | Wakabayashi | 339/12 R |
| 6,250,931 | B1 | 6/2001 | Mendelson | 439/39 |
| 6,267,602 | B1 | 7/2001 | Mendelson et al. | 439/39 |
| 6,379,169 | B1 * | 4/2002 | Corona | 439/271 |
| 6,478,614 | B1 | 11/2002 | De' Longhi | 439/519 |
| 6,527,570 | B1 | 3/2003 | Hartman et al. | 439/180 |
| 6,568,942 | B1 | 5/2003 | Lau et al. | 439/39 |
| 6,607,391 | B1 | 8/2003 | Mendelson et al. | 439/39 |
| 2002/0016088 | A1 | 2/2002 | Mendelson et al. | 439/39 |
| 2002/0017517 | A1 | 2/2002 | Li | 219/494 |
| 2002/0086559 | A1 | 7/2002 | Dalmau Ferrerfabrega et al. | 439/39 |
| 2002/0152897 | A1 | 10/2002 | Bouly et al. | 99/337 |
| 2002/0160629 | A1 | 10/2002 | Lau et al. | 439/39 |
| 2003/0092299 | A1 | 5/2003 | Hartmann et al. | 439/180 |

* cited by examiner

*Primary Examiner*—Alexander Gilman
(74) *Attorney, Agent, or Firm*—Lawrence Cruz; Steven A. Garmer

(57) ABSTRACT

A detachable power supply apparatus for an appliance has a temperature control device and a power supply cord. The temperature control device is removably and electrically connected to the appliance, and has a first member that extends outwardly from a first side of the temperature control device. The temperature control device has a conductor on the first side and has a probe on a second side opposite the first side. The power supply cord has a female electrical connector at a first end connecting to the conductor. The female electrical connector is connectable to a power supply to supply power to the female electrical connector and to the conductor. The power supply cord has a second member. The first member selectively fastens to the second member so that the first member disengages the second member without disturbing a position of the appliance upon application of a force on the power supply cord.

5 Claims, 6 Drawing Sheets

DETACHABLE POWER SUPPLY APPARATUS

BACKGROUND OF THE INVENTION

1. Field of the Invention

The present invention relates to a detachable power supply apparatus. More particularly, the present invention relates to a power supply apparatus that is a breakaway power supply apparatus used with an electrical appliance to increase safety associated with use of the electrical appliance.

2. Description of the Related Art

Detachable power supply devices are known in the art. One such application of a detachable power supply device is used with a temperature probe for a consumer appliance. These temperature probes are used with consumer appliances such as cooking appliances, popcorn makers, cookers, broilers, grillers and deep fat fryers cooking with oil and shortening.

The temperature probe requires a first connection to the cooking appliance such as the deep fat fryer and a second connection to a power supply. The temperature probe accurately maintains and controls an acceptable working temperature of the cooking appliance. The temperature probe is often detachable from the cooking appliance so the temperature probe can be removed from the cooking appliance when washing the cooking appliance. This prevents the temperature probe from getting wet and thus damaged during washing of the cooking appliance.

This first connection to the cooking appliance is usually through a female port on the cooking appliance. The temperature probe has a male member that connects to the female port so that it may be easily removed from the cooking appliance when the cooking appliance is immersed in water and cleaned.

However, there are problems associated with the temperature probes connected to the power supply that are known in the art. If a user trips over a power cord that connects the temperature probe to a power supply at a second connection, a tensile force may be imparted on the power cord and on the cooking appliance. This tensile force pulling at the cooking appliance may potentially risk the cooking appliance falling and tipping over and thus releasing its hot oil and contents on a floor potentially causing damage.

One such attempt in the art to remedy this problem is U.S. Pat. No. 6,267,602 to Mendelson. Mendelson discloses a magnetic assembly. The magnetic assembly has a magnet and a ferrous member to secure a power cord assembly to a temperature probe. However, this arrangement is poor during use with cooking appliances because it has been observed that heat emitted from the cooking appliance can lessen the magnetic properties of the magnet. Thus, the magnet will not appropriately secure the power supply assembly to the temperature probe during extended cooking. This will lead to a detrimental connection between the power cord assembly and the temperature probe and may interrupt power from flowing into the temperature probe.

Accordingly, there is a need for a reliable detachable power supply apparatus for use with a temperature probe. There is a need for such a reliable, and safe, detachable power supply apparatus that will engage the temperature probe to a power cord and also disengage if the power cord is pulled without disturbing the appliance.

There is also a need for such a detachable power supply apparatus that eliminates one or more of the aforementioned drawbacks and deficiencies of the prior art.

SUMMARY OF THE INVENTION

It is an object of the present invention to provide a detachable power supply apparatus for an electric appliance where the detachable power supply apparatus can be removed or pulled without disturbing the electric appliance.

It is another object of the present invention to provide a detachable power supply apparatus that is safe and that will not tip over the electric appliance if pulled or removed.

It is still another object of the present invention to provide a detachable power supply apparatus that has a temperature control device with a first member and a power supply cord with a second member where the first member selectively connects to the second member.

It is yet another object of the present invention to provide a detachable power supply apparatus that has a temperature control device and a power supply cord that selectively fastens to the temperature control device.

It is still yet another object of the present invention to provide a detachable power supply apparatus for an electrical appliance that provides power to an electrical appliance and has a temperature probe that can be removed from the electrical appliance for cleaning.

It is a further object of the present invention to provide a detachable power supply cord that is connected to a temperature probe that disengages upon application of a desired tensile force but remains engaged at a second tensile force less than the desired tensile force.

The above and other objects, advantages and benefits of the present invention will be understood by reference to the detailed description provided below and the accompanying drawings.

DETAILED DESCRIPTION OF THE INVENTION

Figure 1:
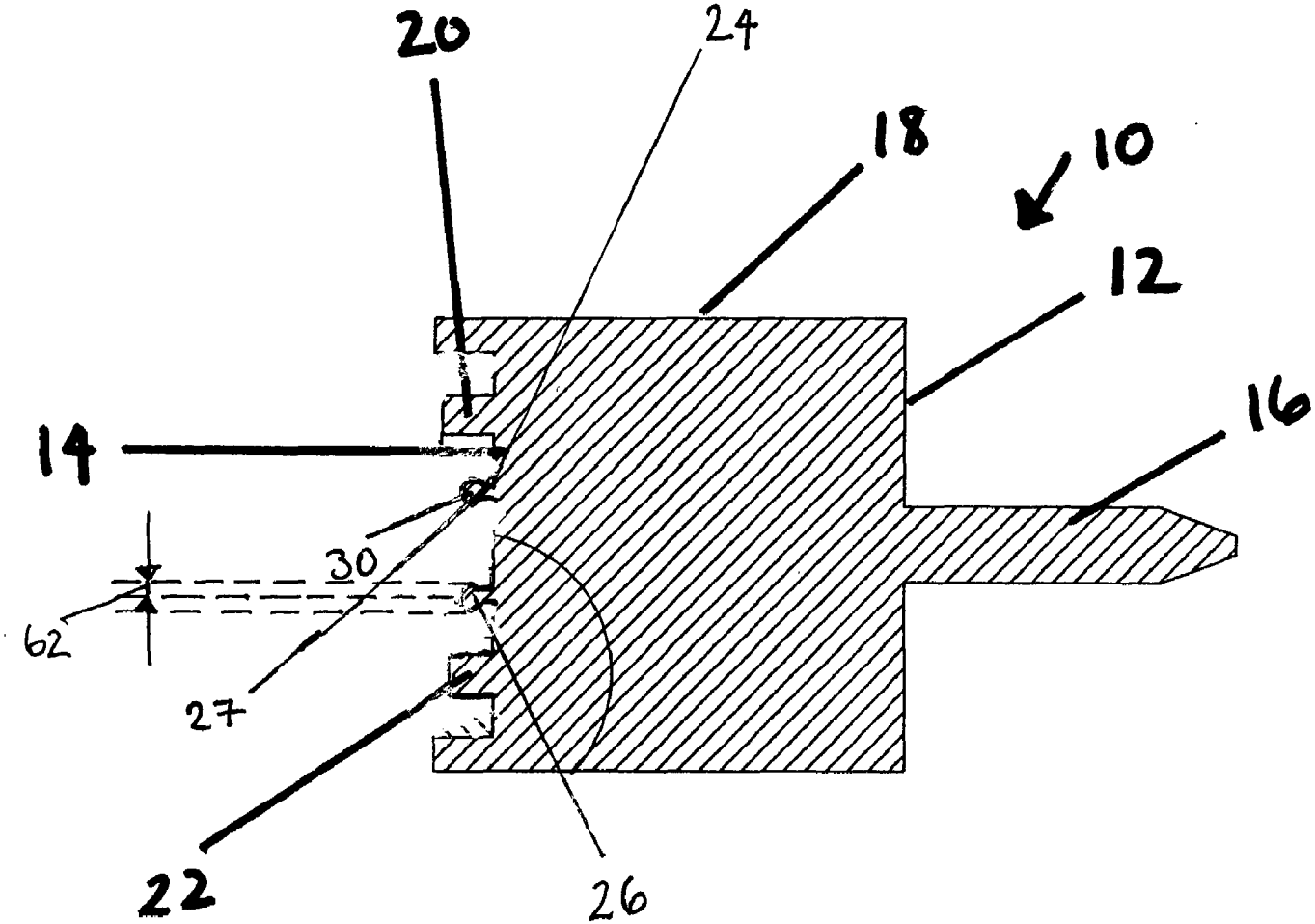
FIG. 1 is a top view of a preferred embodiment of a temperature control device according to the present invention.

Referring to the figures and in particular FIG. 1, there is shown a temperature control device of the present invention generally represented by reference numeral 10. The temperature control device 10 is connectable to an appliance (not shown).

The temperature control device 10 has a first side 12 and a second side 14. The temperature control device 10 has a probe 16 on the first side 12. The probe 16 is located extending outwardly from the temperature control device 10 on the first side 12 and has a length that is suitable to insert the probe into the appliance such as a cooker, a popcorn maker, a griller, a broiler, deep fat fryer or any other electrical appliance known in the art.

Preferably, the probe 16 is made from a thermally conductive material such as a metal, steel, copper or any other ferrous material known in the art. The probe 16 is preferably connected to a thermostat (not shown) positioned preferably, in the temperature control device 10. Optionally, the temperature control device 10 may have a knob, dial or other buttons for controlling the appliance. In one non-limiting embodiment, the temperature control device 10 may control an acceptable temperature level of, for example, a cooking device such as the fryer or the broiler.

The temperature control device 10 has a housing 18. The housing 18 is preferably an orthogonal shaped member that is formed from a resilient and durable material such as a thermoplastic, metal or any resilient and durable material known in the art. Preferably, the housing 18 forms an interior space to house a number of electrical components such as the thermostat and electrical contacts being disposed therein. The temperature control device 10 preferably has the second side 14 as a substantially flat member that is opposite the first side 12.

The temperature control device 10 has a first conductor 20 and a second conductor 22 disposed on the second side 14 of the temperature control device. Preferably, the first and second conductors 20, 22 are a copper, metal or any other suitable electrically conductive material. The first and second conductors 20, 22 extend outwardly from the second side 14 of the temperature control device 10. The first and second conductors 20, 22 are electrically connected to the probe 16 in the housing 18 and supply power from the power source (not shown) to the temperature control device 10.

The temperature control device 10 has a first member 24 and a second member 26. The first and second members 24, 26 also extend outwardly from the temperature control device 10. Preferably, the first member 24 and the second member 26 are each bulbous shaped members. In one embodiment, the first and second members 24, 26 may be pins, catch pins, steel catch pins or any other resilient bulbous members known in the art. Both of the first member 24 and the second member 26 have a stem portion 27 and a spherical portion 30. The first and second members 24, 26 are formed from a suitable resilient material such as a metal, plastic or any other resilient material known in the art.

One skilled in the art should appreciate that the first and the second members 24, 26 alternatively may be rectangular shaped, square shaped, circular, "T" shaped or have any shape known in the art to connect to another member. Preferably, the first and second members 24, 26 are disposed between the first and the second conductors 20, 22 on the second side 14 of the housing 18. However, one skilled in the art should appreciate that the first and second members 24, 26 may be disposed anywhere on the second side with the first and second conductors 20, 22 adjacent to the first and second members or, alternatively, in any other location on the second side 14.

Figure 2:
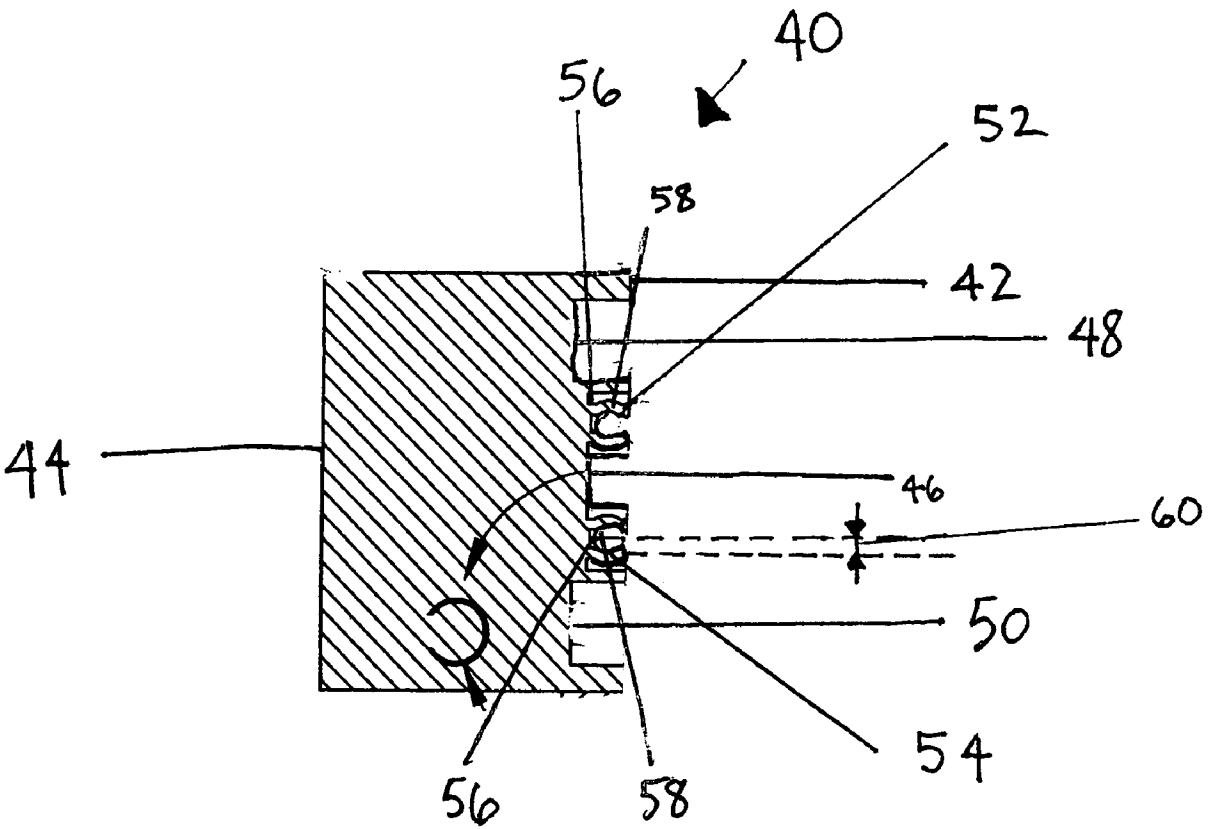
FIG. 2 is a top view of a portion of a power supply cord according to the present invention.

Referring to FIG. 2, there is shown a top view of a power supply cord of the present invention being generally represented by reference numeral 40. The power supply cord 40 preferably has a first side 42 and a second side 44 opposite the first side. The first side 42 has a recess 46 disposed on the first side. The recess 46 is preferably an indentation having a depth disposed in the power supply cord 40. One skilled in the art should appreciate that although the second side 44 is shown as being closely adjacent to the first side 42 for illustration purposes, the second side may be disposed a distance away from the first side depending upon a desired length of the power supply cord 40. One skilled in the art should appreciate that the power supply cord 40 may be two feet, four feet, six feet, ten feet or any other desired length depending upon the consumer's preferences and the availability of electrical outlets to connect the appliance to a power source (not shown).

Referring to the first side 42 of the power supply cord 40 at the recess 46, the power supply cord 40 has a first and second female electrical connectors 48, 50. The first and the second female electrical connectors 48, 50 are preferably apertures disposed in the recess 46 of the power supply cord 40 that allow access to the interior space of the power supply cord. The interior of the power supply cord 40 has a conductive material that is connected to the power source as a conventional wall outlet on the second side 44 of the power supply cord. The first and second female electrical connectors 48, 50 are preferably arranged complementary in position to the first and second conductors 20, 22 of the temperature control device 10 of FIG. 1. The first and second female electrical connectors 48, 50 receive the first and second conductors 20, 22 to energize the same.

The power supply cord 40 has first and second clips 52, 54. The first and second clips 52, 54 are preferably spring clips and are biased to the first side 42 of the power supply cord 40. The first and second clips 52, 54 preferably extend laterally opposite the first side 42 of the power supply cord 40. The first and second clips 52, 54 are preferably connected to the first side 42 of the power supply cord 40 and are disposed to be complementary to the first and second members 24, 26 to engage with the first and second members on the temperature control device 10 of FIG. 1.

The first and the second clips 52, 54 are preferably "C" shaped members. Each of the first and second clips 52, 54 have a stem portion 56 and a clasping portion 58. Although the first and second clips 52, 54 are shown as "C" shaped, the first and the second clips may have any shape known in the art to grasp and retain a suitably sized member therein. The first and second clips 52, 54 may be "V" shaped, "Y" shaped, "U" shaped, "O" shaped or any other shape in the art.

The clasping portion 58 of both the first clip and the second clip 52, 54 are each shown as arcuate in shape and each has a first radius 60. Referring again to FIG. 1, the first and second members 24, 26 each have the spherical portion 30 with a second radius 62. The first radius 60 is preferably slightly larger relative to the second radius 62 so that the spherical portion 30 of the first and the second member 24, 15 of FIG. 1 is held in mating engagement with the clasping portion 58 of the first and second clips 52, 54 of FIG. 2. Preferably, the first radius 60 and the second radius 62 are complementary in size relative to one another such that each of the first and second member 24, 26 selectively fits into and is selectively retained in the respective first and the second clips 52, 54.

Figure 3:
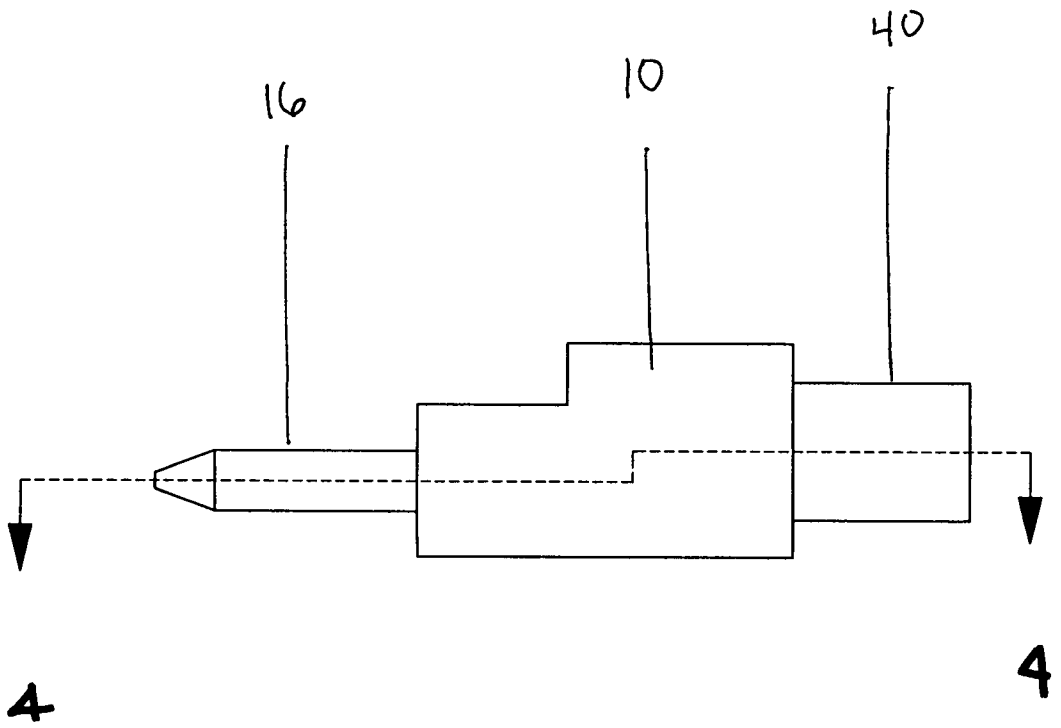
FIG. 3 is a side view of the temperature control device of FIG. 1 being connected to the power supply cord of FIG. 2.

Referring to FIG. 3, there is shown a side view of the temperature control device 10 selectively connected to the power supply cord 40. In this manner, the first and the second conductors 20, 22 of the temperature control device 10 of FIG. 1 are connected to the first and the second female electrical connectors 48, 50 of the power supply cord 40 of FIG. 2. In this manner, when the power supply cord 40 is connected to the temperature control device 10, power traverses through the power supply cord from the power supply, through the first and the second female electrical connectors 48, 50 to the first and the second conductors 20, 22 and to the temperature control device. In this manner, the temperature control device 10 is energized and receives power and the probe 16 may be inserted into a suitable sized port of the appliance to regulate the operating temperature of the appliance.

An aspect of the present invention is that the power supply cord 40 can engage the temperature control device 10 so that if the power supply cord 40 is subject to a tensile force, pulled or a user trips over the power supply cord, the power supply cord will disengage from the temperature control device 10 without disturbing the appliance, let alone toppling the appliance that may have scalding liquid or oil therein.

Figure 4:
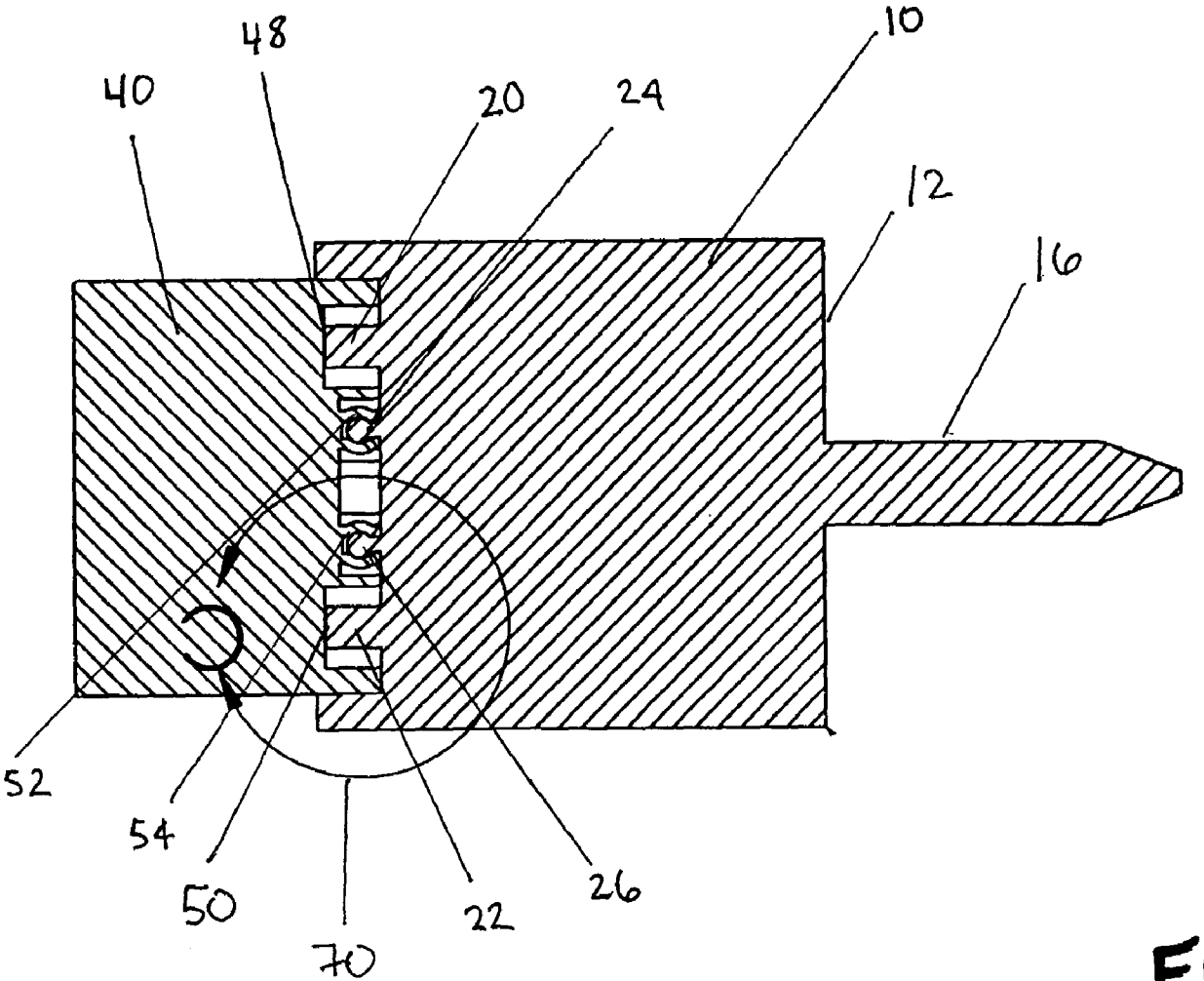
FIG. 4 is a cross sectional top view of an exterior of the temperature control device being connected to the power supply cord along line 4—4 of FIG. 3.
Figure 5:
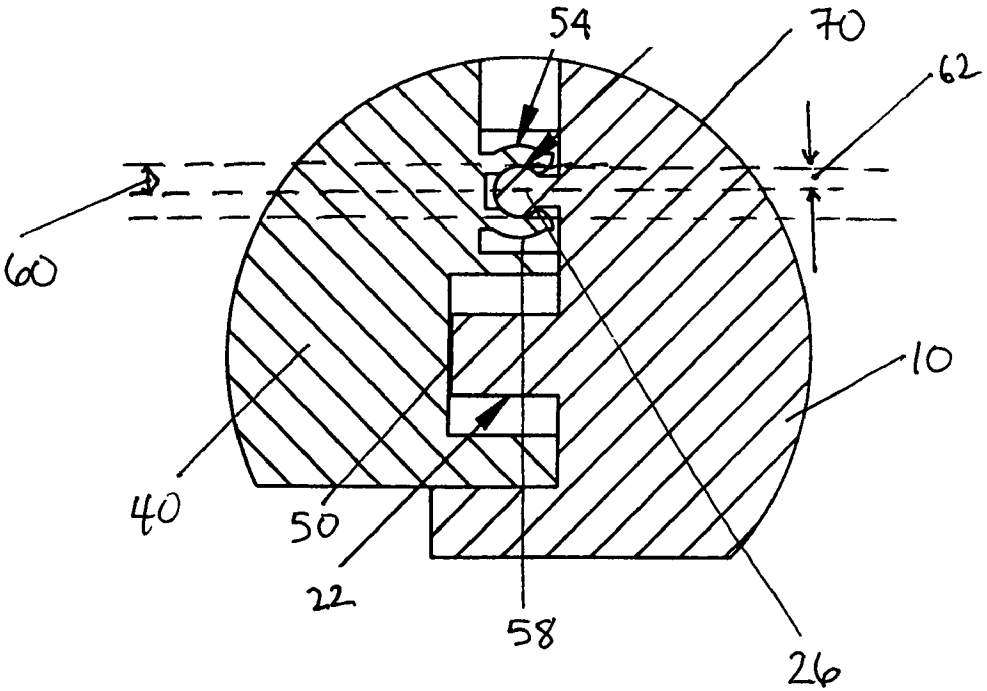
FIG. 5 is a close up view of a clip of the power supply cord and a second member of the temperature control device of FIG. 4 in a first engaged position.

Referring to FIG. 4, a cross sectional view of the temperature control device 10 being engaged to the power supply cord 40 is shown along line 4—4 of FIG. 3. As can be understood from FIG. 4, the first and second conductors 20, 22 are disposed in and in electrical communication with the first and second female electrical connectors 48, 50 of the power supply cord 40. In this connected position, the first and the second members 24, 26 are fastened to the first and the second clips 52, 54 as shown.

Referring to a close up view of the second member 26 in FIG. 4, the second member is connected to the second clip 54 shown in the circle represented generally as reference numeral 70. The second clip 54 has the clasping portion 58. The clasping portion 50 has the first radius 60 that is larger than the second radius 62 of the spherical portion 30 of the second member 26. In this manner, the second member 26 fits into the clasping portion 58 and is held in the clasping portion of the second clip 54. The second member 26 and the clasping portion 58 of the second clip 54 are formed from a preselected durable material and the clasping portion has a desired arc to provide a disengagement tensile force index number 64.

Upon application of a first tensile force to the power supply cord 40 by, for example, pulling the power supply cord with the first tensile force less than the disengagement tensile force index number 64, the clasping portion 58 will remain connected to the spherical portion 30 of the first member 24. Accordingly, this first tensile force is insufficient to disengage the power supply cord 40 from the temperature control device 70 and accordingly the power supply cord will remain connected to the temperature control device.

Figure 6:
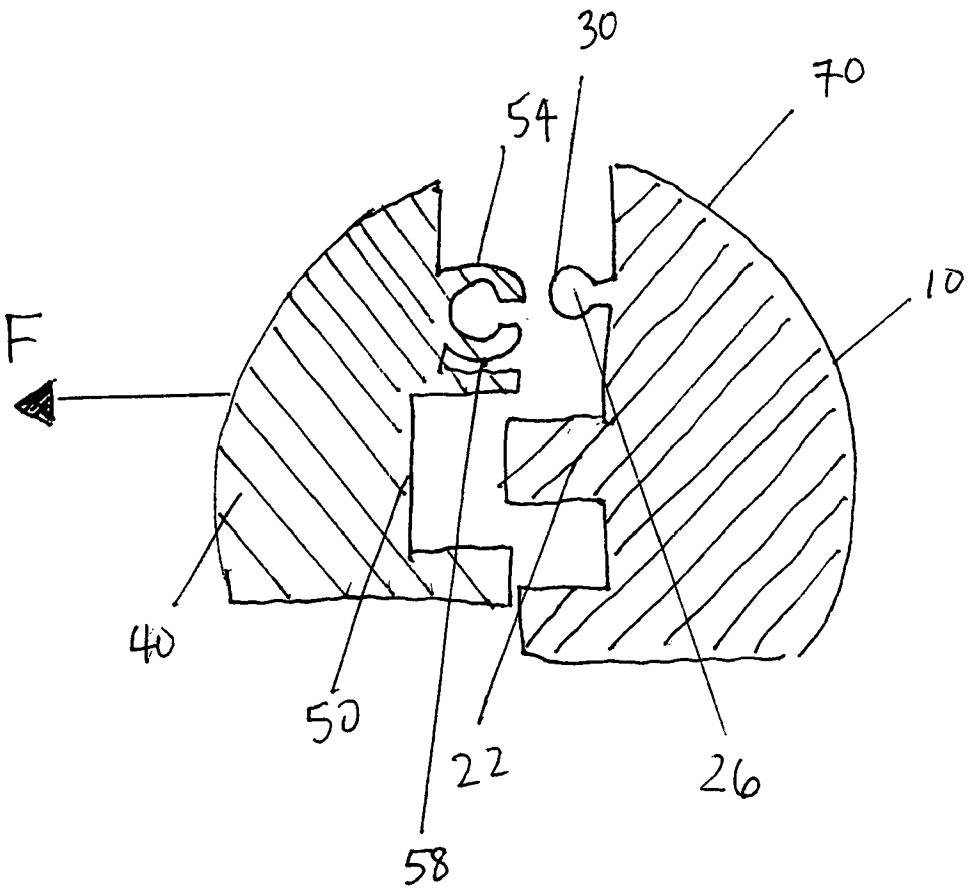
FIG. 6 is a close up view of a clip of the power supply cord and the second member of the temperature control device of FIG. 5 in a second disengaged position.

Referring to FIG. 6, there is shown an alternative position of the power supply cord 40 and the temperature control device 10 in the circle 70. In this second instance, upon an application of a second tensile force F that is relatively larger than the first tensile force that exceeds the disengagement tensile force index number 64, the clasping portion 58 of the second clip 54 will release and disengage the spherical portion 30 of the second member 26. This allows the power supply cord 40 to disengage from the temperature control device 10 allowing the temperature control device to remain connected to the appliance without substantially disturbing the position of the appliance. This will prevent the appliance from being overturned, increase the safety of the power supply cord 40 and thus reduces any risk of potentially harming the user.

One skilled in the art should appreciate that in an alternative embodiment of the present invention the first and the second clips 52, 54 may be disposed on the temperature control device 10 and contemporaneously the first and the second members 24, 26 may be disposed on the power supply cord 40. In yet another alternative embodiment, the power supply cord 40 may have one, two, three or any number of clips, and the temperature control device 10 may have a complementary number of bulbous members thereon to selectively fasten to the power supply cord 40.

It should be understood that the foregoing description is only illustrative of the present invention. Various alternatives and modifications can be devised by those skilled in the art without departing from the invention. Accordingly, the present invention is intended to embrace all such alternatives, modifications and variances.

What is claimed is:

1. A detachable power supply apparatus for an appliance comprising:

a temperature control device for electrical connection to the appliance, said temperature control device having a plurality of first members, said plurality of first members extending outwardly from a first side of said temperature control device, each of said plurality of first members being bulbous members and having a stem and a spherical portion, said temperature control device having a conductor on said first side, said temperature control device having a probe on a second side opposite said first side; and a power supply cord having a female electrical connector at a power supply first end, said female connector connecting to said conductor, said female connector being connectable to a power supply to supply power to said female connector and to said conductor, said power supply cord having a plurality of clips, each of said plurality of clips having a stem portion and a clasping portion, each clasping portion selectively engaging each spherical portion of said plurality of first members for connecting said power supply cord to said temperature control device, wherein said plurality of first members are between a plurality of conductors on said first side.

2. The detachable power supply apparatus of claim 1, wherein said plurality of clips are disposed between a plurality of female electrical connectors on said power supply cord.

3. The detachable power supply apparatus of claim 1, wherein each of said plurality of clips have a shape selected from the group consisting of "C" shaped, "T" shaped, "Y" shaped, "V" shaped, "U" shaped, and any combinations thereof.

4. A detachable power supply apparatus for an appliance comprising:

a first electrical component having a first side and a second side, said second side being opposite said first side, said first electrical component being electrically connected to the appliance by a first conductive member on said first side, said first electrical component having a second conductive member being on said second side; and a second component having a third side and a fourth side, said third side being opposite said fourth side, said second component having a third conductive member connected to a power source at said third side, said second component having a fourth conductive member at said fourth side, wherein said first electrical component has a bulbous catch pin at a first location of said second side, and wherein said second component has a clip at a second location on said fourth side, said first location being complementary to said second location so that said clip releasably engages said bulbous catch pin and releases said bulbous catch pin upon an application of a force upon said second component so that a location of the appliance is not disturbed, wherein said clip is a spring clip, said spring clip being substantially "C" shaped.

5. The detachable power supply of claim 4, wherein when said clip releaseably engages said bulbous catch pin power traverses from said power source to said first electrical component, and wherein power does not traverse from said power source to said first electrical component when said clip releaseably disengages said bulbous catch pin.

* * * * *